US007371496B2

(12) United States Patent
Lee et al.

(10) Patent No.: US 7,371,496 B2
(45) Date of Patent: May 13, 2008

(54) LIQUID TONER FOR ELECTROPHOTOGRAPHY AND METHOD OF PREPARING THE SAME

(75) Inventors: Nam-Jeong Lee, Suwon-si (KR); Kyung-Yol Yon, Seongnam-si (KR); Joong-Hwan Choi, Seoul (KR); Min-Young Cheong, Seoul (KR); Ki-Won Seok, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 711 days.

(21) Appl. No.: 11/013,200

(22) Filed: Dec. 16, 2004

(65) Prior Publication Data

US 2005/0153226 A1 Jul. 14, 2005

(30) Foreign Application Priority Data

Dec. 17, 2003 (KR) ..... 10-2003-0092587

(51) Int. Cl.
*G03G 9/08* (2006.01)

(52) U.S. Cl. ..... 430/115; 430/116; 430/137.22

(58) Field of Classification Search ..... 430/115, 430/116, 137.22

See application file for complete search history.

(56) References Cited

U.S. PATENT DOCUMENTS 3,926,825 A * 12/1975 Honjo et al. ..... 430/115
5,886,067 A 3/1999 Li et al.

FOREIGN PATENT DOCUMENTS

| | | |
|---|---|---|
| JP | 8-220812 | 8/1996 |
| JP | 8-220813 | 8/1996 |
| JP | 10-260558 | 9/1998 |
| JP | 2000-10356 | 1/2000 |
| KR | 10-0190747 | 6/1999 |
| WO | WO 97/12284 | 4/1997 |

* cited by examiner

*Primary Examiner*—Mark A. Chapman
(74) *Attorney, Agent, or Firm*—Roylancd, Abrams, Berdo & Goodman, L.L.P.

(57) ABSTRACT

A liquid toner for electrophotography and a method of preparing the liquid toner are disclosed. The liquid toner includes a carrier liquid, an organosol, a colorant, a charge controlling agent (CCA), and (meth)acrylic (co)polymer soluble in the carrier liquid. The liquid toner has a low solidification rate and good redispersion when left for a long period of time, especially at a high temperature for a long period of time, while maintaining the existing physical properties of a liquid toner, such as image density, at certain levels.

27 Claims, 1 Drawing Sheet

LIQUID TONER FOR ELECTROPHOTOGRAPHY AND METHOD OF PREPARING THE SAME

CROSS-REFERENCE TO RELATED APPLICATION

This application claims the benefit of Korean Patent Application No. 2003-92587, filed on Dec. 17, 2003, in the Korean Intellectual Property Office, the disclosure of which is incorporated herein in its entirety by reference.

BACKGROUND OF THE INVENTION

1. Field of the Invention

The present invention relates to a liquid toner for electrophotography and to a method of preparing the liquid toner. More particularly, the invention relates to a liquid toner for electrophotography having a low solidification rate and good redispersion while maintaining the existing physical properties of a liquid toner, such as image density at certain levels. The invention is also directed to a method of preparing the liquid toner having a low solidification rate that can be readily redispersed after phase separation.

2. Description of the Related Art

Generally, an electrophotographic process includes exposing a charged photoconductor to light by irradiating with an image pattern to form an electrostatic latent image on the charged photoconductor, developing a temporary image by contacting the photoconductor with a liquid developer, and transferring the image and liquid developer to a receiver. The final transferring of the image can be directly from the photoconductor or indirectly via an intermediate transporting member. In general, the developed image remains in a permanently molten state by the application of heat and/or pressure.

The electrophotographic process includes a dry developing method and a wet developing method. In the wet developing method, a toner with a particle size on the sub-micron scale can be used, and a high precision image, which is not obtained in the dry developing method, can be obtained. Also, when using the wet developing method, good gradation is attained and it is easy to fix the toner.

A liquid toner used in the wet developing method is a dispersion composed of charge particles known as toner particles and an insulating liquid acting as a carrier. The liquid toner particles include a polymer binder such as an organosol, a colorant such as a pigment or a dye, and a charge controlling agent. This liquid toner is prepared by adding the organosol, the colorant, and the charge controlling agent to the carrier liquid such as a paraffin oil and milling the mixture in an attrition type milling apparatus.

FIG. 1 schematically illustrates the construction of a conventional liquid toner including the organosol. Referring to FIG. 1, the organosol 10, the colorant 11, and the charge controlling agent 12 are dispersed in the carrier liquid. In this case, the organosol 10 acts as a binder; where the organosol 10 is bonded to the colorant 11 to form toner particles.

The liquid toner prepared as described above easily redisperses to its original state by appropriately stirring at room temperature when left for a short period of time. However, toner particles can settle and aggregate and separated from the carrier liquid to form a kind of layer when left for a long period of time, especially at a high temperature.

Once aggregated, ink agglomerates do not easily redisperse to its original state even when a strong shearing force is artificially applied thereto.

In addition, when trying to print using the liquid toner that has separated or has agglomerated particles, which is difficult to redisperse as described above, it is difficult to introduce the liquid toner to a developer, and thus, printing is impossible. Even if printing were possible, an image defect can be caused by the agglomerated liquid toner particles that are not sufficiently redispersed. Also, a serious problem may be caused during the storage and distribution of the liquid toner.

Attempts have been made to resolve the above problems by using various additives. Japanese Patent Laid-Open Publication Nos. hei 8-220812 and hei 8-220813 disclose a liquid developer for electrophotography, having a soluble alkali dispersed resin and/or acidic dispersed resin dispersed in a carrier liquid.

Although stable charge characteristics of toner particles and improved developing speed can be expected by the addition of the soluble alkali dispersed resin and/or acidic dispersed resin, it is difficult to prepare a liquid toner having good stability during a high temperature storage, such as a low solidification rate, and good redispersion.

SUMMARY OF THE INVENTION

The present invention provides a liquid toner for electrophotography, having a low solidification rate and good redispersion while maintaining the existing physical properties of a liquid toner, such as image density at certain levels.

According to an aspect of the present invention, there is provided a liquid toner for electrophotography including a carrier liquid; an organosol including a thermoplastic (co) polymer core insoluble in the carrier liquid and a (co) polymer graft stabilizer covalently linked to the thermoplastic (co)polymer core; a colorant; a charge controlling agent; and a (meth)acrylic (co)polymer that is soluble in the carrier liquid.

According to another aspect of the present invention, there is provided a method of preparing a liquid toner for electrophotography, the method including mixing a $C_{6-30}$ (meth)acrylic monomer component and a polymerization initiator with a carrier liquid and polymerizing the monomer component to obtain a graft stabilizer dispersed in the carrier liquid; mixing a $C_{4-30}$ (meth)acrylic monomer component and a polymerization initiator with the graft stabilizer dispersed in the carrier liquid and polymerizing the monomer component to obtain an organosol dispersed in the carrier liquid; and mixing a colorant, a charge controlling agent, and a (meth)acrylic (co)polymer soluble in the carrier liquid with the organosol dispersed in the carrier liquid.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
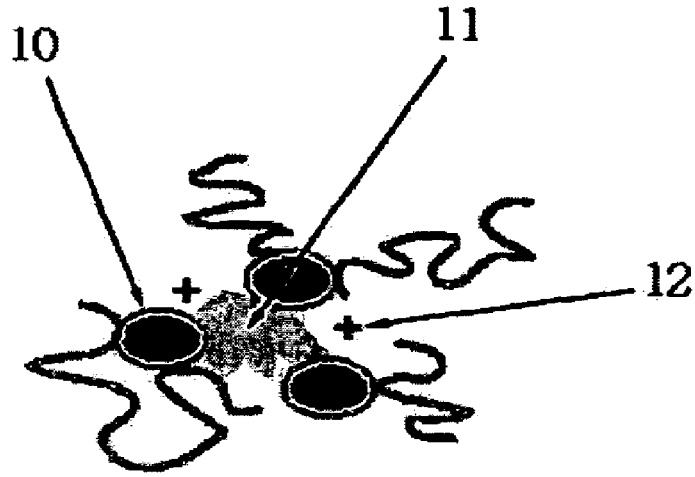
FIG. 1 schematically illustrates the construction of a conventional liquid toner including an organosol.

A liquid toner for electrophotography according to an embodiment of the present invention includes a carrier liquid, an organosol, a colorant, a charge controlling agent, and a (meth)acrylic (co)polymer that is soluble in the carrier liquid. The organosol includes a thermoplastic (co)polymer core that is insoluble in the carrier liquid and a (co)polymer graft stabilizer covalently linked to the thermoplastic (co) polymer core of the organosol.

The graft stabilizer preferably includes a repeating unit derived from a $C_{6-30}$ (meth)acrylic monomer. The repeating unit of the graft stabilizer is more preferably derived from at least one monomer selected from the group consisting of hexyl (meth)acrylate, 2-ethylhexyl (meth)acrylate, 2-hydroxyethyl (meth)acrylate, decyl (meth)acrylate, dodecyl (meth)acrylate, lauryl (meth)acrylate, octadecyl (meth)acrylate, stearyl (meth)acrylate, behenyl (meth)acrylate, and trimethyl cyclohexyl (meth)acrylate.

The thermoplastic (co)polymer core of the organosol preferably includes a repeating unit derived from a $C_{4-30}$ (meth)acrylic monomer. The repeating unit is more preferably derived from at least one monomer selected from the group consisting of methyl (meth)acrylate, ethyl (meth) acrylate, butyl (meth)acrylate, trimethyl cyclohexyl (meth) acrylate, behenyl (meth)acrylate, and octadecyl (meth)acrylate.

The (co)polymer graft stabilizer stabilizes toner particles by undergoing a graft reaction with the thermoplastic (co) polymer core of the organosol. The weight ratio of the thermoplastic (co)polymer core and the (co)polymer graft stabilizer may range between about 1:1 to about 15:1. The bonding ability to the colorant and the dispersion of the stabilizer are poor and the charging of the liquid toner particles does not easily occur when the weight ratio is outside the above range.

The organosol formed by the graft reaction of the graft stabilizer with the core acts as a binder strongly interacting with the colorant. The concentration of the organosol may be 1-20 parts by weight based on 1 part by weight of the colorant. The fixability of the liquid toner may deteriorate at concentrations of less than 1 part by weight, and image density may decrease at concentrations of more than 20 parts by weight.

The liquid toner according to an embodiment of the present invention includes the charge controlling agent to provide the liquid toner particles with uniform charge polarity. When preparing a liquid toner for electrophotography, the charge controlling agent may be those commonly used in the art. Examples of suitable charge controlling agents include, but are not limited to, a fatty acid metallic salt, a sulfoxynate metallic salt, an alkyl-benzenesulfonic acid metallic salt, an aromatic carboxylic acid metallic salt, a polyoxyethylated alkylamine, lecithin, polyvinylpyrolidone, basic barium petronate, calcium petronate, and mixtures thereof.

The concentration of the charge controlling agent may be 0.001-1 part by weight based on 1 part by weight of the colorant. Developing process does not proceed smoothly and an image defect may occur due to a lower charge quantity of the liquid toner particles when the charge controlling agent is included at a concentration of less than 0.001 part by weight. The image density may decrease when the charge controlling agent is included at a concentration of more than 1 part by weight.

The type and the concentration of the charge controlling agent vary depending on various factors such as the composition of each of the graft stabilizer and the organosol, the molecular weight and particle size of the organosol, the type of colorant, the concentration ratio of the organosol and the colorant, and the like.

Figure 2:
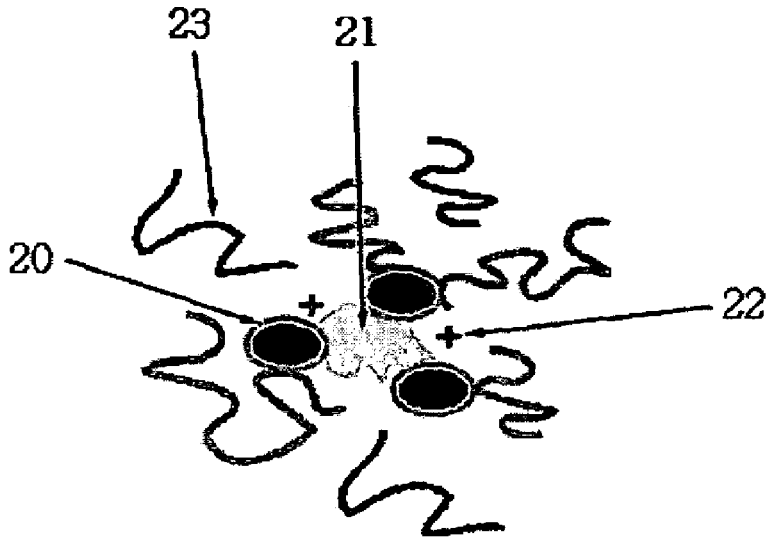
FIG. 2 schematically illustrates the construction of a liquid toner according to an embodiment of the present invention.

Unlike a conventional organosol liquid toner, the liquid toner for electrophotography according to an embodiment of the present invention includes a (meth)acrylic (co)polymer that is soluble in the carrier liquid. FIG. 2 schematically illustrates the construction of the liquid toner according to an embodiment of the present invention. Referring to FIG. 2, the (meth)acrylic (co)polymer 23 that is soluble in the carrier liquid is dispersed in the liquid toner together with the organosol 20, the colorant 21, and the charge controlling agent 22 to improve the dispersion of the liquid toner particle and the storage stability of the liquid toner without seriously affecting the existing physical properties of the liquid toner.

The (meth)acrylic (co)polymer that is soluble in the carrier liquid includes preferably a repeating unit derived from a $C_{6-30}$ (meth)acrylic monomer, and more preferably, a repeating unit derived from at least one monomer component selected from the group consisting of hexyl (meth) acrylate, 2-ethylhexyl (meth)acrylate, 2-hydroxyethyl (meth)acrylate, decyl (meth)acrylate, dodecyl (meth)acrylate, lauryl (meth)acrylate, octadecyl (meth)acrylate, stearyl (meth)acrylate, behenyl (meth)acrylate, and trimethyl cyclohexyl (meth)acrylate.

The concentration of the (meth)acrylic (co)polymer soluble in the carrier liquid may be about 1 to about 20 parts by weight based on a total 100 parts by weight of the total combined weight of the colorant and the organosol. The (meth)acrylic (co)polymer does not act as a dispersant, resulting in a lowered storage stability at a concentration of less than 1 part by weight. Further, the charge performance of the liquid toner particles may deteriorate due to an excessive amount of dispersant, and production costs increase when the (meth)acrylic (co)polymer is included at a concentration of more than 20 parts by weight based on 100 parts of the total combined weight of the colorant and organosol.

The (meth)acrylic (co)polymer soluble in the carrier liquid may have a weight average molecular weight of 10,000-300,000. The fixability of the liquid toner may be lowered when the (meth)acrylic (co)polymer has a weight average molecular weight of less than 10,000, and the viscosity of the liquid toner increases when the (meth)acrylic (co)polymer has a weight average molecular weight of higher than 300,000.

The carrier liquid is a lipophilic, chemically stable, insulating liquid. This insulating liquid has a dielectric constant of no higher than 5 and an electrical resistance ratio of no lower than $1\times10^9$. The carrier liquid may be in a liquid state and is not viscous (low viscosity) at standard operating temperatures, thereby allowing charged particles to easily move during developing. Also, the carrier liquid must be chemically inactive to materials or apparatuses used in a wet electrophotographic process, in particular, a photoconductor and a releasing surface thereof.

Examples of the carrier liquid include, but are not limited to, aliphatic hydrocarbons such as n-pentane, hexane, and heptane; alicyclic hydrocarbons such as cyclopentane and cyclohexane; aromatic hydrocarbons such as benzene, toluene, and xylene; halogenated hydrocarbon solvents such as chlorinated alkanes, fluorinated alkanes, and chlorofluorocarbons; silicone oils and waxes; polyethylene waxes; branched paraffin waxes and oils; stearic acid amides; and mixtures thereof.

The carrier liquid must have a low viscosity so that the liquid toner particles can migrate during developing. Also, the carrier liquid must have sufficient volatility to be properly removed from a substrate on which the final image is formed, but also have sufficient nonvolatility to minimize losses due to the evaporation of the carrier liquid from the stored developer. A carrier liquid having the above characteristics is selected.

The concentration of the carrier liquid may be about 4 to about 100 parts by weight based on 1 part by weight of the toner solid. A flow property of the liquid toner deteriorates due to too high viscosity of the liquid toner when the concentration of the carrier liquid is less than 4 parts by weight. The image density decreases due to a low absolute amount of the toner solid when the concentration of the carrier liquid is more than 100 parts by weight.

The colorant may be those commonly used in the art when preparing a liquid toner for electrophotography. Examples of suitable colorants include, but are not limited to, carbon black and aniline black in the case of black toners, carbon black as black colorants, and yellow, magenta, and cyan colorants as color colorants in color toners.

Examples of the yellow colorant include a condensed nitrogen compound, an isoindolinone compound, an anthraquine compound, an azo metal complex, and an allyl imide compound. Specifically, C.I. pigment yellow 12, 13, 14, 17, 62, 74, 83, 93, 94, 95, 109, 110, 111, 128, 129, 147, or 168 may be used.

Examples of the magenta colorant include a condensed nitrogen compound, an antraquine compound, a quinacridone compound, a naphthol compound, a benzo imidazole compound, a thioindigo compound, and a pherylene compound. Specifically, C.I. pigment red 2, 3, 5, 6, 7, 23, 48:2, 48:3, 48:4, 57:1, 81:1, 144, 146, 166, 169, 177, 184, 185, 202, 206, 220, 221, or 254 may be used.

Examples of the cyan colorant include a copper phthalocyanine compound and derivatives thereof, and an anthraquine compound. Specifically, C.I. pigment blue 1, 7, 15, 15:1, 15:2, 15:3, 15:4, 60, 62, or 66 may be used.

These colorants may be used alone or in combination and are selected in consideration of color, saturation, brightness, weatherproofing properties, and dispersion in the toner.

A method of preparing a liquid toner for electrophotography according to another embodiment of the present invention includes mixing a $C_{6-30}$ (meth)acrylic monomer component and a polymerization initiator with a carrier liquid and polymerizing the monomer component to obtain a graft stabilizer dispersed in the carrier liquid; mixing a $C_{4-30}$ (meth)acrylic monomer component and a polymerization initiator with the graft stabilizer dispersed in the carrier liquid and polymerizing the monomer component to obtain an organosol dispersed in the carrier liquid; and mixing a colorant, a charge controlling agent, and a (meth)acrylic (co)polymer soluble in the carrier liquid with the organosol dispersed in the carrier liquid.

The polymerization initiator used in the method of the present invention is radically decomposed by heat or a reductive material to perform an addition polymerization of monomers. Examples of the polymerization initiator include water-soluble or lipid-soluble persulfates, peroxides, and azobis compounds. Specifically, potassium persulfate, ammonium persulfate, t-butylhydroperoxide, hydrogen peroxide, azobisisobutyronitrile (AIBN), rongalite, and sodium metabisulfite may be used. These compounds may be used alone or in combination. The polymerization initiator may be, if desired, used together with a transition metal ion. Examples of the transition metal ion include, but are not limited to, iron sulfate (II), copper chloride (II), and iron chloride (II).

The present invention will now be described in greater detail with reference to the following examples. The following examples are for illustrative purposes only and are not intended to limit the scope of the invention.

PREPARATION EXAMPLE 1

Preparation of an Organosol (1) Preparation of a Graft Stabilizer 2557 g of Norpar 12 (available from Exxon), 849 g of trimethyl cyclohexyl methacrylate (TCHMA), 27 g of 2-hydroxyethyl methacrylate (HEMA), and 13 g of dimethyl-2,2'-azobis(2-methylpropionate) (tradename: V601, available from Wako Chem, Japan) as a polymerization initiator were mixed and reacted for 16 hours while stirring at a rate of 250 rpm at 70° C. under a nitrogen gas atmosphere. Then, the reaction mixture was heated for 1 hour while stirring at a rate of 250 rpm at 90° C. to remove the residual polymerization initiator. 14 g of dibutyltin dilaurate (DBTDL available from Aldrich Chemical Co.) and 41 g of 3-isopropenyl dimethylbenzyl isocyanate (TMI available from CYTEC Industries) were added to the reaction mixture, and then the resulting mixture was reacted for 6 hours while stirring at a rate of 250 rpm at 70° C. under a nitrogen gas atmosphere to obtain the graft stabilizer. The prepared graft stabilizer was a copolymer of TCHMA and HEMA.

(2) Preparation of an Organosol 187 g of the graft stabilizer prepared above, 2934 g of Norpar 12, 325 g of ethyl methacrylate (EMA), 49 g of ethyl acrylate (EA), and 6 g of dimethyl-2,2'-azobis(2-methylpropionate) (tradename: V601, available from Wako Chem, Japan) as a polymerization initiator were mixed and reacted for 16 hours while stirring at a rate of 250 rpm at 75° C. under a nitrogen gas atmosphere to obtain the organosol. Then, the organosol was cooled to room temperature, and 350 g of n-heptane was added thereto. A rotary evaporator equipped with a dry ice/acetone condenser and operating at 97° C. in a vacuum at 15 mmHg was used to remove residual monomers from the formed mixture. When the obtained organosol was cooled to room temperature, it became an opaque liquid dispersion.

PREPARATION EXAMPLE 2

Preparation of a (meth)acrylic (co)polymer Soluble in a Carrier Liquid 2557 g of Norpar 12 (available from Exxon), 849 g of trimethyl cyclohexyl methacrylate (TCHMA), 27 g of 2-hydroxyethyl methacrylate (HEMA), and 13 g of dimethyl-2,2'-azobis(2-methylpropionate) (tradename: V601, available from Wako Chem, Japan) as a polymerization initiator were mixed and reacted for 16 hours while stirring at a rate of 250 rpm at 70° C. under a nitrogen gas atmosphere. Then, the reaction mixture was heated for 1 hour while stirring at a rate of 250 rpm at 90° C. to remove a residual polymerization initiator.

EXAMPLE 1

Preparation of a Liquid Toner for Electrophotography According to the Present Invention 435.2 g (solid weight ratio: 13%) of the organosol prepared in Preparation Example 1, 13.3 g (solid weight ratio: 25%) of a (meth)acrylic (co)polymer soluble in a carrier liquid, prepared in Preparation Example 2, 9.43 g of Cyan pigment PB 15:4 (available from Sun Chemical) as a colorant, 2.75 g (2.4%) of Zr-HEXEM as a charge controlling agent, and 139.5 g of Norpar 12 (available from Exxon) were placed in an attrition type milling apparatus, and then 1200 g of a zirconium bead was added thereto. Then, the mixture was milled at 42° C. for 3 hours while stirring at a rate of 5000 rpm to obtain the liquid toner for electrophotography.

EXAMPLE 2

Preparation of a Liquid Toner for Electrophotography According to the Present Invention A liquid toner for electrophotography was prepared in the same manner as in Example 1, except that 26.6 g (solid weight ratio: 25%) of a (meth)acrylic (co)polymer that is soluble in a carrier liquid was added.

The image densities of the image area and the non-image area were determined by developing the liquid toner in an organophotoconductor drum and then taping an image on the drum.

The high temperature storage stability was determined as follows: after the liquid toner was left in an oven at 50° C. for 6 days, the weight (Y) of aggregated ink agglomerate and the total weight (X) of the liquid toner were measured. Next, after the liquid toner was stirred at a rate of 600 rpm for 5 minutes, the weight (Z) of the remaining ink agglomerate was measured. The high temperature storage stability was calculated from these measurements. In this case, the solidification rate (%) and the redispersion (%) could be represented as follows:

Solidification rate (%)=Y/X×100

Redispersion (%)=(Y−Z)/Y×100

The results of the image evaluating test are shown in Table 1 below.

TABLE 1

| Liquid toner | Volume average particle size (μm) | Number average particle size (μm) | Q/M (μC/g) | Solidification rate (%) | Redispersion rate (%) | Image density of image area (OD) | Image density of non-image area (OD) |
|---|---|---|---|---|---|---|---|
| Example 1 | 3.45 | 0.24 | 252 | | | 1.85 | 0.01 |
| Example 1 (after storing at a high temperature) | 3.49 | 0.24 | 176 | 22 | 76 | 1.77 | 0.00 |
| Example 2 | 3.54 | 0.24 | 273 | | | 1.82 | 0.00 |
| Example 2 (after storing at a high temperature) | 3.60 | 0.24 | 230 | 19 | 85 | 1.79 | 0.01 |
| Comparative Example | 4.06 | 0.23 | 169 | | | 1.99 | 0.01 |
| Comparative Example (after storing at a high temperature) | 4.46 | 0.21 | 107 | 70 | Unable to be measured | Unable to be measured | Unable to be measured |

COMPARATIVE EXAMPLE

Preparation of a Conventional Liquid Toner for Electrophotography

A liquid toner for electrophotography was prepared in the same manner as in Example 1, except that a (meth)acrylic (co)polymer that is soluble in a carrier liquid was not added.

Image Evaluating Test

Measurements of particle size, charge quantity per unit weight of a liquid toner (Q/M), high temperature storage stability (solidification rate and redispersion), and image densities of an image area and a non-image area were performed on liquid toners for electrophotography prepared in Examples 1 and 2 and the Comparative Example.

The particle size was measured using Horiba 910.

A Q/M (μC/g) measurement was determined as follows: the liquid toner diluted to a constant concentration was placed between an ITO glass and an iron plate, and an electric field of 300 kV/m was applied thereto. The liquid toner adsorbed to the ITO glass was dried and then weighed. Then, a current between the ITO glass and the iron plate was measured and the Q/M was calculated.

As is apparent from Table 1 above, the liquid toner for electrophotography according to the present invention has an image density similar to the conventional liquid toner for electrophotography and has a lower solidification rate and a better redispersion than the conventional liquid toner for electrophotography.

As described above, a liquid toner according to the present invention has a low solidification rate, good redispersion, and long-term storage stability while maintaining the existing physical properties of a liquid toner, such as an image density, at certain levels.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid toner for electrophotography comprising:

a carrier liquid;

an organosol including a thermoplastic (co)polymer core that is insoluble in the carrier liquid and a (co)polymer graft stabilizer covalently linked to the thermoplastic (co)polymer core;

a colorant;

a charge controlling agent; and a (meth)acrylic (co)polymer that is soluble in the carrier liquid.

2. The liquid toner of claim 1, wherein the (co)polymer graft stabilizer includes a repeating unit derived from a $C_{6-30}$ (meth)acrylic monomer.

3. The liquid toner of claim 2, wherein the $C_{6-30}$ (meth) acrylic monomer is at least one monomer component selected from the group consisting of hexyl (meth)acrylate, 2-ethylhexyl (meth)acrylate, 2-hydroxyethyl (meth)acrylate, decyl (meth)acrylate, dodecyl (meth)acrylate, lauryl (meth) acrylate, octadecyl (meth)acrylate, stearyl (meth)acrylate, behenyl (meth)acrylate, and trimethyl cyclohexyl (meth) acrylate.

4. The liquid toner of claim 1, wherein the thermoplastic (co)polymer core includes a repeating unit derived from a $C_{4-30}$ (meth)acrylic monomer.

5. The liquid toner of claim 4, wherein the $C_{4-30}$ (meth) acrylic monomer is at least one monomer component selected from the group consisting of methyl (meth)acrylate, ethyl (meth)acrylate, butyl (meth)acrylate, trimethyl cyclohexyl (meth)acrylate, behenyl (meth)acrylate, and octadecyl (meth)acrylate.

6. The liquid toner of claim 1, wherein a weight ratio of the thermoplastic (co)polymer core and the (co)polymer graft stabilizer is about 1:1 to about 15:1.

7. The liquid toner of claim 1, wherein the concentration of the organosol is 1-20 parts by weight based on 1 part by weight of the colorant.

8. The liquid toner of claim 1, wherein the charge controlling agent is at least one component selected from the group consisting of a fatty acid metallic salt, a sulfoxynate metallic salt, an alkyl-benzenesulfonic acid metallic salt, an aromatic carboxylic acid metallic salt, a polyoxyethylated alkylamine, lecithin, polyvinylpyrolidone, basic barium petronate, and calcium petronate.

9. The liquid toner of claim 1, wherein the concentration of the charge controlling agent is 0.001-1 part by weight based on 1 part by weight of the colorant.

10. The liquid toner of claim 1, wherein the (meth)acrylic (co)polymer that is soluble in the carrier liquid includes a repeating unit derived from a $C_{6-30}$ (meth)acrylic monomer.

11. The liquid toner of claim 10, wherein the $C_{6-30}$ (meth)acrylic monomer is at least one monomer component selected from the group consisting of hexyl (meth)acrylate, 2-ethylhexyl (meth)acrylate, 2-hydroxyethyl (meth)acrylate, decyl (meth)acrylate, dodecyl (meth)acrylate, lauryl (meth) acrylate, octadecyl (meth)acrylate, stearyl (meth)acrylate, behenyl (meth)acrylate, and trimethyl cyclohexyl (meth) acrylate.

12. The liquid toner of claim 1, wherein the concentration of the (meth)acrylic (co)polymer soluble in the carrier liquid is 1-20 parts by weight based on total 100 parts by weight of the total combined weight of the colorant and the organosol.

13. The liquid toner of claim 1, wherein the (meth)acrylic (co)polymer soluble in the carrier liquid has a weight average molecular weight of 10,000-300,000.

14. The liquid toner of claim 1, wherein the carrier liquid is selected from the group consisting of aliphatic hydrocarbons, alicyclic hydrocarbons, aromatic hydrocarbons, halogenated hydrocarbon solvents, silicone oils and waxes, polyethylene waxes, branched paraffin waxes and oils, stearic acid amides, and mixtures thereof.

15. The liquid toner of claim 14, wherein said aliphatic hydrocarbon is selected from the group consisting of n-pentane, hexane, and heptane.

16. The liquid toner of claim 14, wherein said alicyclic hydrocarbon is selected from the group consisting of cyclopentane and cyclohexane.

17. The liquid toner of claim 14, wherein said aromatic hydrocarbon is selected from the group consisting of benzene, toluene, and xylene.

18. The liquid toner of claim 14, wherein said halogenated hydrocarbon is selected from the group consisting of chlorinated alkanes, fluorinated alkanes, and chlorofluorocarbons.

19. The liquid toner of claim 1, wherein the concentration of the carrier liquid is 4-100 parts by weight based on 1 part by weight of the toner solids.

20. The liquid toner of claim 1, wherein the colorant is a carbon black or an aniline black; a yellow colorant selected from the group consisting of a condensed nitrogen compound, an isoindolinone compound, an antraquine compound, a azo metal complex, and an allyl imide compound; a magenta colorant selected from the group consisting of a condensed nitrogen compound, an antraquine compound, a quinacridone compound, a naphthol compound, a benzo imidazole compound, a thioindigo compound, and a pherylene compound; a cyan colorant selected from the group consisting of a copper phthalocyanine compound and a derivative thereof, and an antraquine compound; or a mixture of the forgoing materials.

21. A method of preparing a liquid toner for electrophotography, the method comprising:

mixing a $C_{6-30}$ (meth)acrylic monomer component and a polymerization initiator with a carrier liquid and polymerizing the monomer component to obtain a graft stabilizer dispersed in the carrier liquid;

mixing a $C_{4-30}$ (meth)acrylic monomer component and a polymerization initiator with the graft stabilizer dispersed in the carrier liquid and polymerizing the monomer component and the graft stabilizer to obtain an organosol dispersed in the carrier liquid; and mixing a colorant, a charge controlling agent, and a (meth)acrylic (co)polymer that is soluble in the carrier liquid with the organosol dispersed in the carrier liquid.

22. The method of claim 21, wherein the (meth)acrylic (co)polymer soluble in the carrier liquid includes a repeating unit derived from a $C_{6-30}$ (meth)acrylic monomer.

23. The method of claim 22, wherein the $C_{6-30}$ (meth) acrylic monomer is at least one monomer component selected from the group consisting of hexyl (meth)acrylate, 2-ethylhexyl (meth)acrylate, 2-hydroxyethyl (meth)acrylate, decyl (meth)acrylate, dodecyl (meth)acrylate, lauryl (meth) acrylate, octadecyl (meth)acrylate, stearyl (meth)acrylate, behenyl (meth)acrylate, and trimethyl cyclohexyl (meth) acrylate.

24. The method of claim 21, wherein the concentration of the (meth)acrylic (co)polymer soluble in the carrier liquid is 1-20 parts by weight based on total 100 parts by weight of the total combined weight of the colorant and the organosol.

25. The method of claim 21, wherein the (meth)acrylic (co)polymer soluble in the carrier liquid has a weight average molecular weight of 10,000-300,000.

26. The method of claim 21, wherein said $C_{4-30}$ (meth) acrylic monomer component forms a thermoplastic core and where said graft stabilizer is covalently bonded to said thermoplastic core.

27. The method of claim 26, wherein said thermoplastic core is insoluble in said liquid carrier.

* * * * *